US008021078B2

(12) United States Patent
Lamb

(10) Patent No.: US 8,021,078 B2
(45) Date of Patent: Sep. 20, 2011

(54) CONVEYOR ASSEMBLY FOR AN ASPHALT PAVING MACHINE

(75) Inventor: Stan Lamb, Casey, IL (US)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 12/692,888

(22) Filed: Jan. 25, 2010

(65) Prior Publication Data

US 2011/0182665 A1 Jul. 28, 2011

(51) Int. Cl.
*E01C 19/18* (2006.01)
*B65G 15/00* (2006.01)

(52) U.S. Cl. ..... 404/108; 198/836.1

(58) Field of Classification Search ..... 404/95, 404/108; 198/952, 836.1
See application file for complete search history.

(56) References Cited

U.S. PATENT DOCUMENTS 2,784,854 A * 3/1957 Roberts ..... 414/528
3,608,446 A * 9/1971 Plant ..... 404/83
3,866,742 A * 2/1975 Freese et al. ..... 198/730
4,405,089 A * 9/1983 Taylor ..... 239/656
4,741,431 A * 5/1988 Whitehead ..... 198/844.1
4,819,790 A * 4/1989 Adcock ..... 198/811
4,874,283 A * 10/1989 Hurley, Jr. ..... 414/504
5,383,547 A * 1/1995 Noda ..... 198/728
5,533,829 A * 7/1996 Campbell ..... 404/81
6,481,925 B1 * 11/2002 Olson ..... 404/108
7,694,805 B2 * 4/2010 Schneider et al. ..... 198/836.1
2004/0094384 A1 * 5/2004 Shaw et al. ..... 193/35 R

* cited by examiner

*Primary Examiner* — Thomas Will
*Assistant Examiner* — Abigail A Risic
(74) *Attorney, Agent, or Firm* — Michael Best & Friedrich LLP

(57) ABSTRACT

Conveyor assemblies for an asphalt paving machine and an asphalt paving machine. The conveyor assembly may include a first conveyor, a second conveyor generally parallel to the first conveyor, a central space being defined between the first conveyor and the second conveyor, and a cover assembly. The cover assembly may include a cover member positioned over the central space and covering the conveyor inner chains, the cover member having an upper surface substantially parallel to the conveyor surfaces, the cover member substantially preventing material from entering the central space between the first conveyor and the second conveyor, and a divider member connected to the cover member and extending generally perpendicular to the upper surface. The conveyor assembly may include scraper members operable to move material on the upper surface of the cover during movement of the conveyor chains.

20 Claims, 8 Drawing Sheets

CONVEYOR ASSEMBLY FOR AN ASPHALT PAVING MACHINE

FIELD OF THE INVENTION

The present invention relates to asphalt paving machines and, more specifically, to a conveyor assembly for an asphalt paving machine.

SUMMARY

Asphalt paving machines are used to lay down a mat of asphalt material to construct roads, parking lots, driveways, etc. Generally, asphalt material is dispensed from a hopper onto a conveyor assembly which conveys the material from the hopper to a distribution end of the paving machine. The material is deposited on a working surface and formed into a mat by means of augers and screeds. An asphalt paving machine may include two side-by-side conveyor assemblies so as to be able to lay down a mat of varying width.

One independent problem with some existing asphalt paving machines is center-line segregation of components of the asphalt material. This problem may reveal itself as a flaw or long streak in the mat, most often in-line with the location of the auger drive box of the paving machine. The flaw may be produced due to a lack of homogeneity of the asphalt material in the streaked area. This problem may occur in the asphalt mix when larger stones/aggregate is allowed to separate as the asphalt material is conveyed towards the drop point of the paving machine. Although the problem may occur at any point along the mat, it is more commonly found at the center because the material is not picked-up and stirred properly by the augers.

In some independent aspects and in some constructions, a conveyor assembly for an asphalt paving machine may generally include a cover assembly operable to cover a space between adjacent conveyors, and the cover assembly may have an inverted "T" shape. The conveyor assembly may generally include a first conveyor including a first conveyor surface having an inner edge and an outer edge, and a first drive chain adjacent the inner edge of the conveyor surface, the first drive chain being movable to cause material to be conveyed on the first conveyor surface, a second conveyor generally parallel to the first conveyor, a central space being defined between the first conveyor and the second conveyor, the second conveyor including a second conveyor surface having an inner edge and an outer edge, and a second drive chain adjacent the inner edge of the conveyor surface, the second drive chain being movable to cause material to be conveyed on the second conveyor surface, and a cover assembly. The cover assembly may include a cover member positioned over the central space and covering the first drive chain and the second drive chain, the cover member having an upper surface substantially parallel to the first conveyor surface and to the second conveyor surface, the cover member substantially preventing material from entering the central space between the first conveyor and the second conveyor, and a divider member connected to the cover member and extending generally perpendicular to the upper surface.

In another independent aspect and in some constructions, a conveyor assembly for an asphalt paving machine may generally include a cover assembly to cover a space between adjacent conveyors and a scraper member operable to scrape asphalt material on an upper surface of the conveyor assembly. The conveyor assembly may generally include a first conveyor including a first conveyor surface having an inner edge and an outer edge, and a first drive chain adjacent the inner edge of the first conveyor surface, the first drive chain being movable to cause material to be conveyed on the first conveyor surface, a second conveyor generally parallel to the first conveyor, a central space being defined between the first conveyor and the second conveyor, the second conveyor including a second conveyor surface having an inner edge and an outer edge, and a second drive chain adjacent the inner edge of the second conveyor surface, the second drive chain being movable to cause material to be conveyed on the second conveyor surface, a cover positioned over the central space and covering the first drive chain and the second drive chain, the cover having an upper surface, the cover substantially preventing material from entering the central space between the first conveyor and the second conveyor, a first scraper member and a second scraper member.

The first scraper member may be connected to the first drive chain and extending inwardly beyond the inner edge of the first conveyor surface, the first scraper member extending over a first portion of the upper surface of the cover when the first drive chain is positioned with the first scraper member above the upper surface, the first scraper member being operable to move material on the upper surface of the cover during movement of the first drive chain. The second scraper member may be connected to the second drive chain and extending inwardly beyond the inner edge of the second conveyor surface, the second scraper member extending over a second portion of the upper surface of the cover when the second drive chain is positioned with the second scraper member above the upper surface, the second scraper member being operable to move material on the upper surface of the cover during movement of the second drive chain.

In yet another independent aspect and in some constructions, an asphalt paving machine may generally include a cover assembly operable to cover a space between adjacent conveyors, a first scraper member operable to scrape material on one side of the cover assembly, and a second scraper member operable to scrape material on an opposite side of the cover assembly. The cover assembly may have an inverted "T" shape.

The asphalt paving machine may generally include a first conveyor including a first conveyor surface having an inner edge and an outer edge, a first inner chain adjacent the inner edge of the conveyor surface, a first outer chain adjacent the outer edge of the conveyor surface, and a plurality of first pushers connected to the first inner chain and to the first outer chain, each first pusher being movable to convey material on the first conveyor surface, a second conveyor generally parallel to the first conveyor, a central space being defined between the first conveyor and the second conveyor, the second conveyor including a second conveyor surface having an inner edge and an outer edge, a second inner chain adjacent the inner edge of the conveyor surface, a second outer chain adjacent the outer edge of the conveyor surface, and a plurality of second pushers connected to the second inner chain and to the second outer chain, each second pusher being movable to convey material on the second conveyor surface, a hopper for dispensing material to be conveyed onto the first conveyor and onto the second conveyor, a cover assembly, a plurality of first pusher members, and a plurality of second pusher members.

The cover assembly may include a cover member positioned over the central space and covering the first inner chain and the second inner chain, the cover member having an upper surface substantially parallel to the first conveyor surface and to the second conveyor surface, the cover member substantially preventing material from entering the central space between the first conveyor and the second conveyor, and a divider member connected to the cover member and extending generally perpendicular to the upper surface. Each first scraper member may be connected to an associated first pusher and extending inwardly beyond the inner edge of the first conveyor surface, each first scraper member extending over a first portion of the upper surface of the cover member and to one side of the divider member when the first inner chain is positioned with the first scraper member above the upper surface, each first scraper member being operable to move material on the upper surface of the cover member during movement of the first inner chain. Each second scraper member may be connected to an associated second pusher and extending inwardly beyond the inner edge of the second conveyor surface, each second scraper member extending over a second portion of the upper surface of the cover member and to an opposite side of the divider member when the second inner chain is positioned with the second scraper member above the upper surface, each second scraper member being operable to move material on the upper surface of the cover member during movement of the second inner chain.

Independent features and independent advantages of the present invention will become apparent to those skilled in the art upon review of the following detailed description, claims and drawings.

Figure 1:
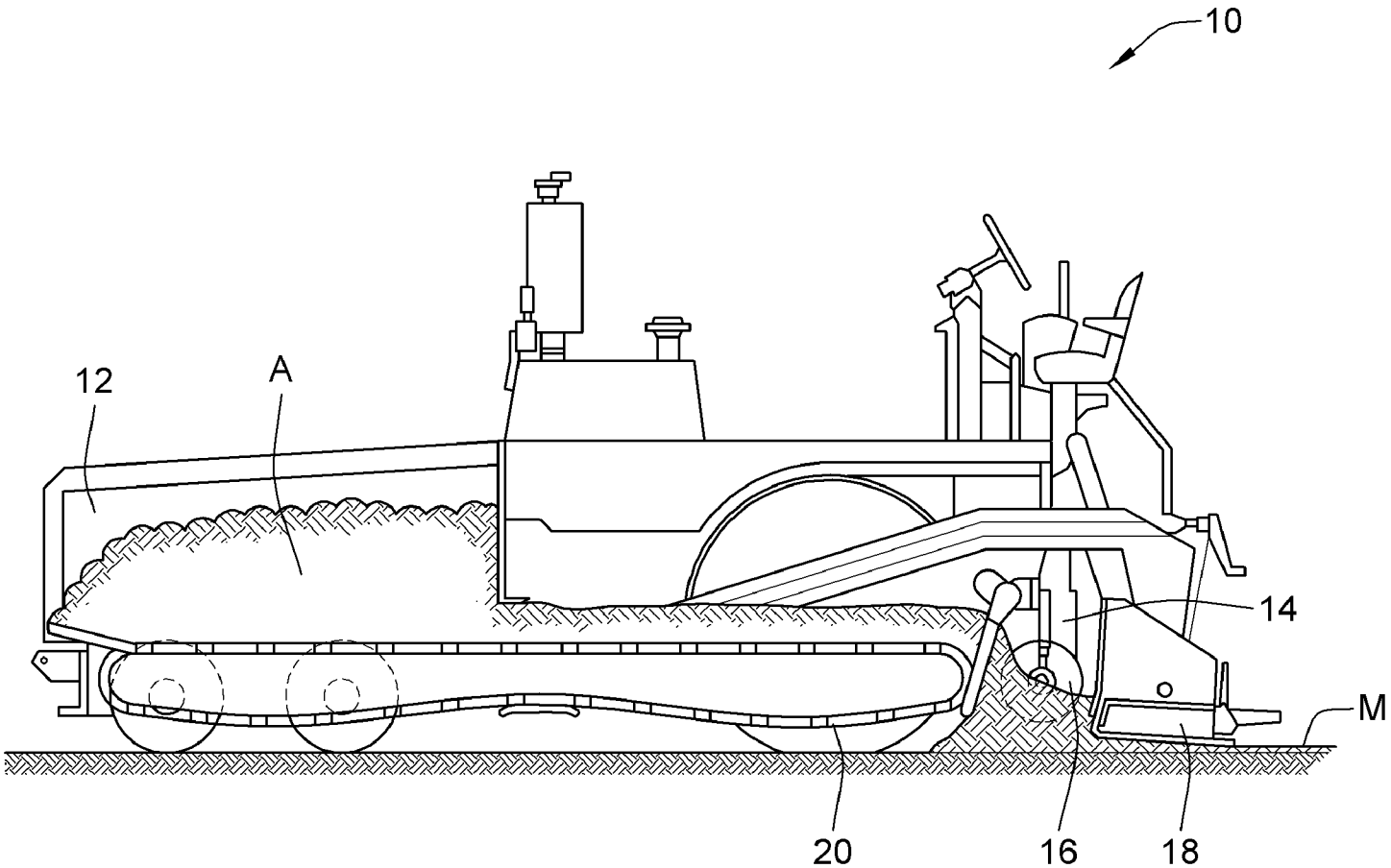
FIG. 1 is a side view of an asphalt paving machine, illustrating a paving operation.
Figure 2:
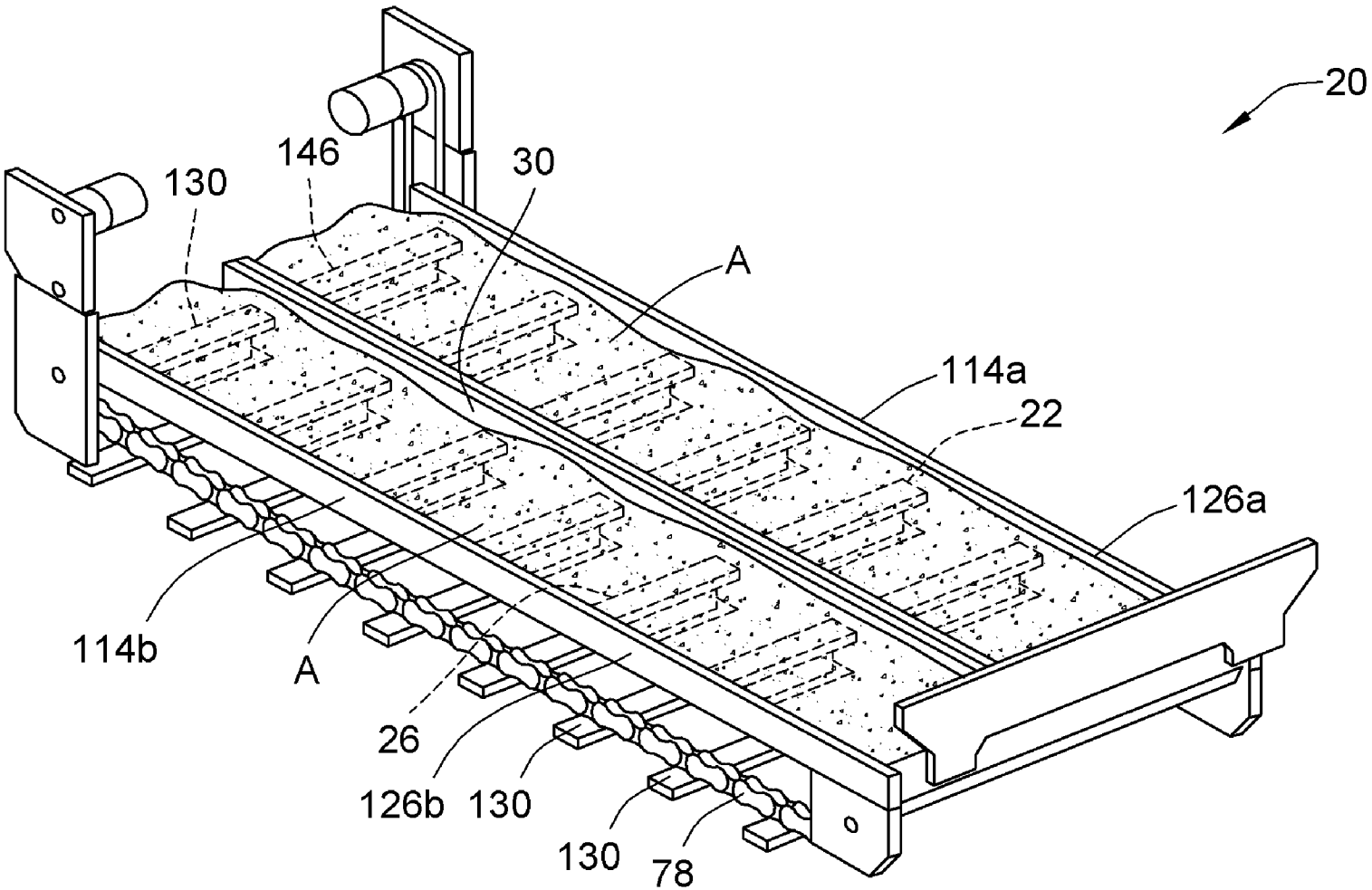
FIG. 2 is a rear perspective view of a conveyor assembly for the asphalt paving machine embodying independent aspects of the invention, illustrating conveying of the asphalt material.

Before any independent features and at least one construction of the invention are explained in detail, it is to be understood that the invention is not limited in its application to the details of construction and the arrangements of the components set forth in the following description or illustrated in the drawings. The invention is capable of other constructions and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

Although reference may be made below to directions, such as upper, lower, downward, upward, rearward, bottom, front, rear, etc., in describing the drawings, these references are made relative to the drawings (as normally viewed) for convenience. These directions are not intended to be taken literally or limit the present invention in any form. In addition, terms such as "first" and "second" are used herein for purposes of description and are not intended to indicate or imply relative importance or significance.

DETAILED DESCRIPTION

FIG. 1 illustrates an asphalt paving machine or paver 10 generally used to construct roads, parking lots, runways, etc. In the illustrated construction, the paver 10 includes a hopper 12 generally located toward the front of the paver 10 and has a distribution end 14 generally opposite the hopper 12 toward the rear of the paver 10. An auger 16 and a screed 18 are provided at the distribution end 14. A conveyor assembly 20 generally extends between the hopper 12 and the distribution end 14. During paving operations, asphalt material A from the hopper 12 is conveyed to the distribution end 14 by the conveyor assembly 20 to be deposited on a working surface to, thereafter, form a continuous asphalt mat M.

In the illustrated construction (see FIGS. 2-4 and 6), the conveyor assembly 20 includes two generally parallel conveyors 22 and 26. The conveyors 22 and 26 are spaced apart a distance to define a central space 28 between the conveyors 22 and 26. A cover assembly 30 is positioned to prevent asphalt material A from entering the central space 28.

Figure 3:
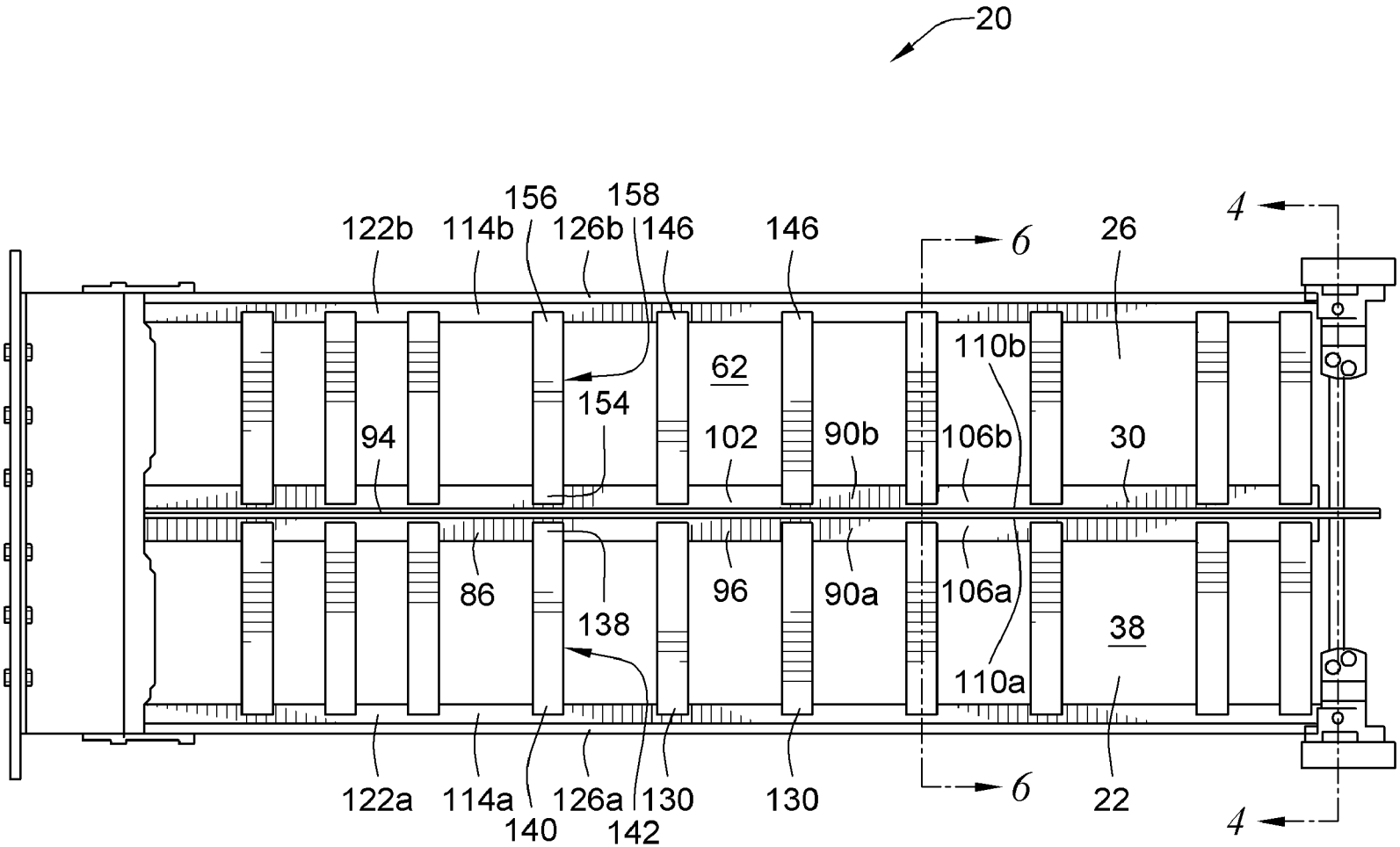
FIG. 3 is a top view of a conveyor assembly shown in FIG. 2 without asphalt material.
Figure 4:
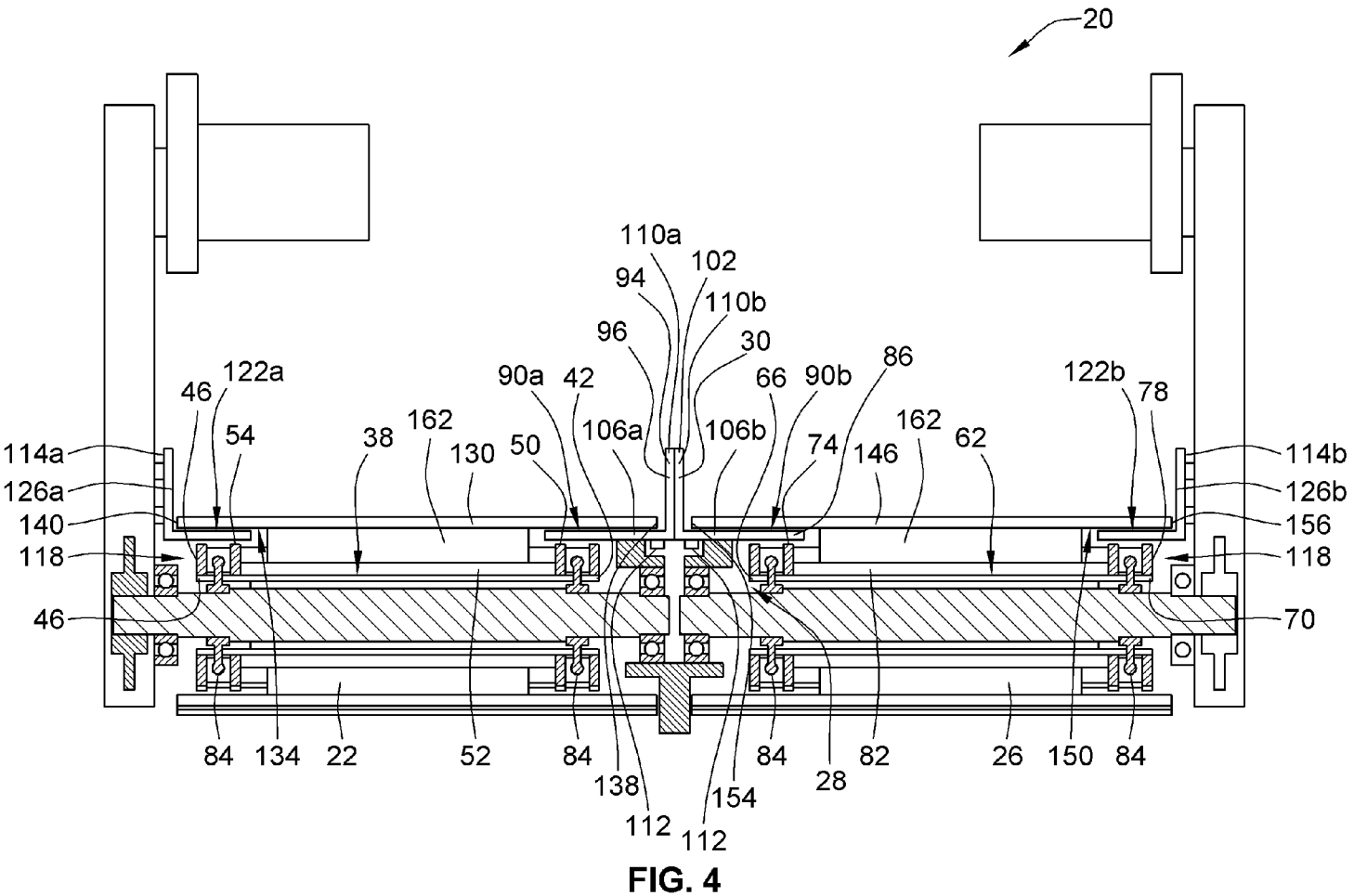
FIG. 4 is a partial cross-sectional view taken generally along line 4-4 in FIG. 3.
Figure 6:
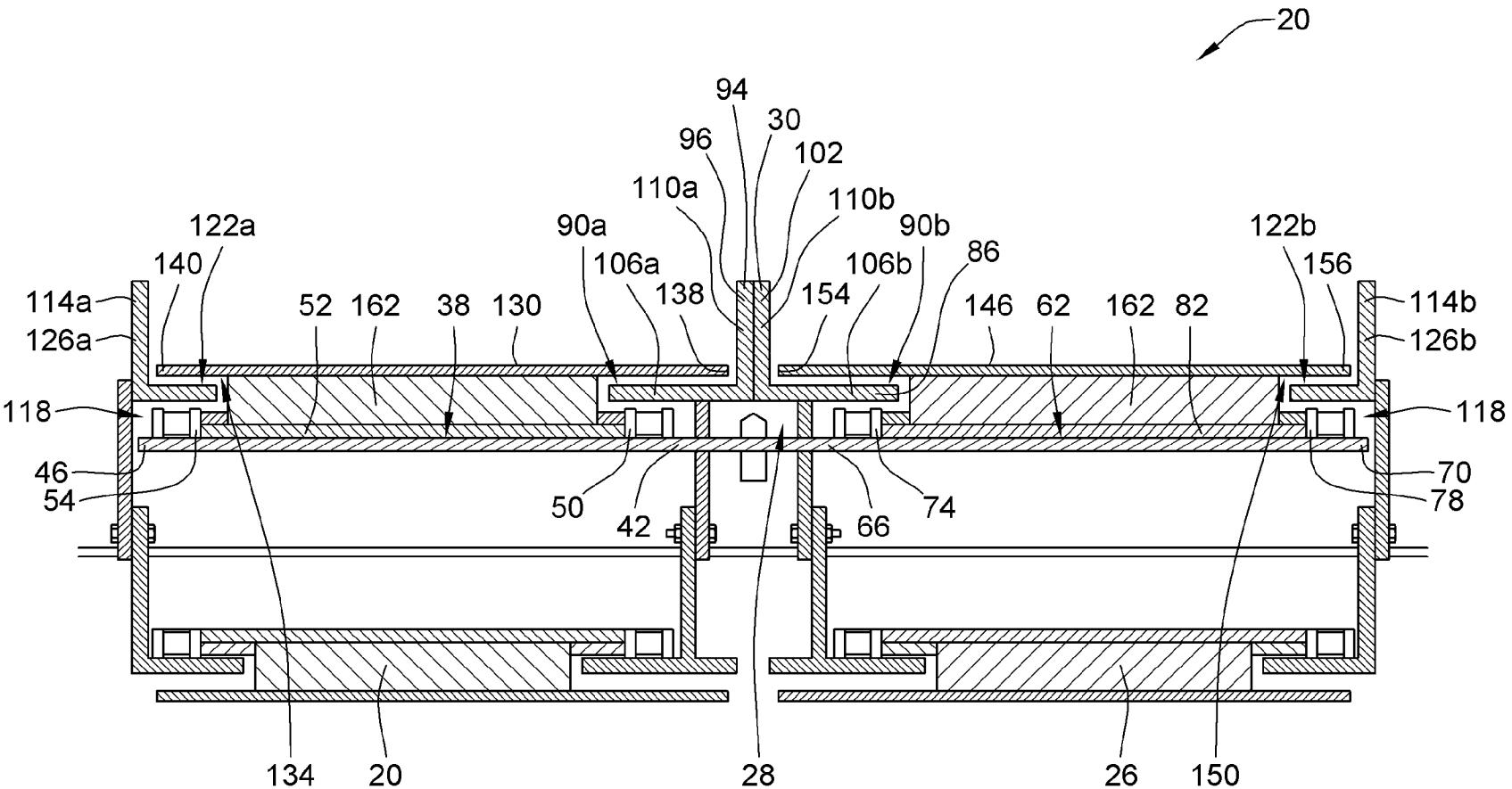
FIG. 6 is a cross-sectional view taken generally along line 6-6 in FIG. 3.
Figure 7:
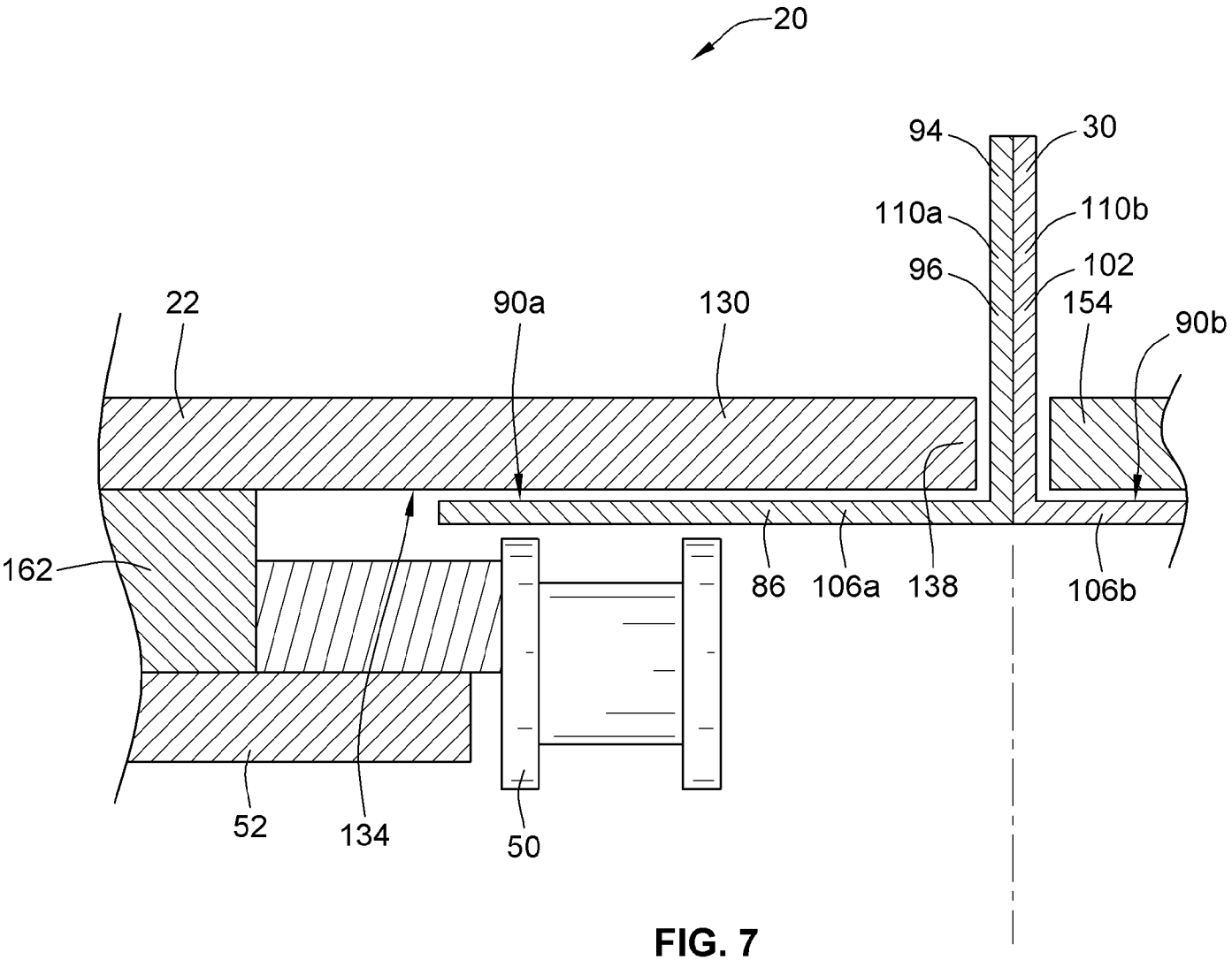
FIG. 7 is an enlarged view of a portion of the conveyor assembly shown in FIG. 6.

As shown in FIGS. 3-4 and 6, the first conveyor 22 includes a first conveyor surface 38 having inner and outer edges 42 and 46, a first inner chain 50 adjacent the inner edge 42, a first outer chain 54 adjacent the outer edge 46, and a plurality of first pushers 52 positioned generally equally along the length of and coupled to the chains 50 and 54. The first pushers 52 are movable with the chains 50 and 54 along the first conveyor surface 38 to convey or push asphalt material A on the first conveyor surface 38 toward the distribution end 14.

The second conveyor 26 includes a second conveyor surface 62 having inner and outer edges 66 and 70, a second inner chain 74 adjacent the inner edge 66, a second outer chain 78 adjacent the outer edge 70, and a plurality of second pushers 82 positioned generally equally along the length of and coupled to the chains 74 and 78. The second pushers 82 are movable with the chains 74 and 78 along the second conveyor surface 62 to convey or push asphalt material A positioned on the second conveyor surface 62 toward the distribution end 14. In the illustrated construction, the second conveyor 26 is operable independently of the first conveyor 22. However, in alternative constructions, the conveyors 22 and 26 may be synchronized to act as a single conveyor unit.

In a typical manner, each chain 50, 54, 74 and 78 forms a closed loop, generally extending around a drive sprocket 84 (see FIGS. 4-5) at the distribution end 14 and a pickup sprocket (not shown) at the other end to provide endless motion of the conveyors 22 and 26. Each chain 50, 54, 74 and 78 is generally supported by its associated conveyor surface 38, 62 (FIG. 5) when traversing over the conveyor surface 38, 62.

As shown in FIGS. 3-4 and 6-7, the cover assembly 30 is positioned to generally prevent asphalt material A from entering the central space 28 between the conveyors 22 and 26 and from interfering with the operation of the chains 50, 54, 74 and 78 and the sprockets. The cover assembly 30 also cooperates to minimize segregation of components of the asphalt material A.

The cover assembly 30 generally extends the length of the conveyors 22 and 26, at least from the point the hopper 12 deposits asphalt material A on the conveyor assembly 20 to at or beyond the point where the conveyed asphalt material A could enter the central space 28 and interfere with the chains 50, 54, 74 and 78 and the sprockets. In the illustrated construction, the cover assembly 30 includes a cover member 86 covering the first inner chain 50 and the second inner chain 74 and a divider member 94 extending generally perpendicular the cover member 86.

The cover member 86 generally extends transversely beyond at least one of the first inner chain 50 and the second inner chain 74 to provide an upper surface 90 that prevents asphalt material A from entering the central space 28. In the illustrated construction, the cover member 86 is generally rectangular in shape when viewed from above (as in FIG. 3). In alternative constructions, the cover member 86 may define any suitable shape as desired to provide coverage of the central area 28, clearance with other components, etc.

In the illustrated construction, the upper surface 90 of the cover member 86 is substantially parallel to the first conveyor surface 38 and/or the second conveyor surface 62. In other constructions, the first and second conveyor surfaces 38, 62 may not be parallel, and, in such cases, the upper surface 90 of the conveyor member 86 may be at least partially parallel the first conveyor surface 38 and/or at least partially parallel the second conveyor surface 62. In yet another construction, the upper surface 90 of the conveyor member 86 may be in a generally horizontal orientation regardless of the orientation of the conveyor surface(s) 38, 62.

Also illustrated in FIGS. 2 and 4-7, the divider member 94 extends generally perpendicular the upper surface 90 of the cover member 86. In the illustrated construction the divider member 94 and cover member 86 are generally about the same length. In alternative constructions, the cover member 86 and the divider member 94 may have different lengths.

In the illustrated construction, the cover assembly 30 is provided by a first cover section 96 and a second cover section 102. In the illustrated construction, each cover section 96, 102 has a substantially "L" shape, including a first leg 106*a*, 106*b*, providing a portion of the upper surface 90, and a second leg 110*a*, 110*b*, providing a portion of the divider member 94 generally perpendicular the first legs 106*a*, 106*b*. The first leg 106*a* of the first cover section 96 extends transversely beyond the first inner chain 50 and parallel the first conveyor surface 38 to provide a first portion 90*a* of the upper surface 90. Similarly, the first leg 106*b* of the second cover section 102 extends transversely beyond the second inner chain 74 and parallel the second conveyor surface 62 to provide a second portion 90*b* of the upper surface 90.

The center cover assembly 30 is coupled to the paver 10 by fasteners 112. In the illustrated construction the cover member 86 of the cover assembly 30 defines threaded recesses 113 through each of which a fastener 112 is introduced from below (e.g., through the frame of the paver 10). In alternative constructions, the center cover assembly 30 may be coupled to the paver 10 by any suitable fastening arrangement, such as, for example, by welding, riveting, etc.

In the illustrated construction, a first outer chain cover 114*a* extends over the first outer chain 54, and a second outer chain cover 114*b* extends over the second outer chain 78. The outer chain covers 114*a*, 114*b* substantially prevent asphalt material A from entering the outer lateral spaces 118 of the conveyors 22, 26 and interfering with operation of the outer chains 54 and 78 and the sprockets. In the illustrated construction, each outer chain cover 114*a*, 114*b* defines an upper surface 122*a*, 122*b* substantially parallel the corresponding conveyor surface 38, 62.

Each outer chain cover 114*a*, 114*b* may also include an outer upright member 126*a*, 126*b* extending generally perpendicular to the upper surface 122*a*, 122*b*. In some alternative constructions, portions of each outer chain cover 114*a*, 114*b* may be angled with respect to the vertical or horizontal plane.

As shown in FIGS. 3-7, a plurality of first scraper members 130 are coupled to the plurality of first pushers 52. In the illustrated construction, each scraper member 130 extends inwardly beyond the inner edge 42 of the first conveyor surface 38. Each scraper member 130, when positioned above the upper surface 90*a*, extends inwardly over at least a portion of the upper surface 90*a* and toward the divider member 94. The scraper members 130 are operable to convey asphalt material A on the upper surface 90*a* of the cover member 86 during movement of the chains 50, 54.

In the illustrated construction, each scraper member 130 also extends outwardly beyond the outer edge 46 of the first conveyor surface 38. Each scraper member 130 extends outwardly over at least a portion of the upper surface 122*a* of the outer chain cover 114*a* and toward the upright member 126*a*. The scraper members 130 are also operable to convey asphalt material A on the upper surface 122*a* of the outer chain cover 114*a* during movement of the chains 50, 54.

Each scraper member 130 has a lower surface 134 movable along the first portion 90*a* of the upper surface 90 and an inner end 138 generally extending to the divider member 94. Each scraper member 130 also has an outer end 140 generally extending to the upright portion 126*a* of the outer chain cover 114*a*, and the lower surface 134 is also movable along the upper surface 122*a* of the outer chain cover 114*a*. Each scraper member 130 has a forward surface 142 substantially perpendicular to the upper surface 90*a*, when positioned above the upper surface 90*a*, of the cover member 86 and engageable with the asphalt material A. The forward surface 142 of the scraper member 130 is co-planar with the forward surface of the associated first pusher 52 to provide a pushing surface engageable with the asphalt material A.

A plurality of second scraper members 146 are coupled to the plurality of second pushers 82. In the illustrated construction, each scraper member 146 extends inwardly beyond the inner edge 66 of the second conveyor surface 62. Each scraper member 146, when positioned above the upper surface 90*b*, extends inwardly over at least a portion of the upper surface 90*b* and toward the divider member 94. The scraper members 146 are operable to convey asphalt material A on the upper surface 90*b* of the cover member 86 during movement of the chains 74, 78.

In the illustrated construction, each scraper member 146 also extends outwardly beyond the outer edge 70 of the second conveyor surface 62. Each scraper member 146 extends outwardly over at least a portion of the upper surface 122*b* and toward the upright member 126*b*. The scraper members 146 are also operable to convey asphalt material A on the upper surface 122*b* of the outer chain cover 114*b* during movement of the chains 74, 78.

Each scraper member 146 has a lower surface 150 movable along the first portion 90*b* of the upper surface 90 and an inner end 154 generally extending to the divider member 94. Each scraper member 146 also has an outer end 156 generally extending to the upright portion 126*b* of the outer chain cover 114*b*, and the lower surface 150 is also movable along the upper surface 122*b* of the outer chain cover 114*b*. Each scraper member 146 has a forward surface 158 substantially perpendicular to the upper surface 90*b* of the cover member 86 and engageable with the asphalt material A. The forward surface 158 of the scraper member 146 is co-planar with the forward surface of the associated second pusher 82 to provide a pushing surface engageable with the asphalt material A.

In the illustrated construction, each scraper member 130, 146 is coupled to its associated pusher 52, 82 by a shim 162. Each shim 162 is sized and arranged to properly position the scraper member 130, 146 with respect to the cover assembly 30 such that the scraper members 130, 146 move asphalt material A on the upper surface 90 without interference between the scraper members 130, 146 and the cover assembly 30. In alternative constructions, the scraper member 130, 146 may be coupled directly to the pushers 58, 82 or use another arrangement to be properly positioned with respect to the cover assembly 30.

As discussed above, in the illustrated construction, each scraper member 130, 146 extends transversely beyond the inner and outer edges 42, 46, 66, 70 of the first and second conveyor surfaces 38, 62, respectively. However, in alternative constructions (not shown), a scraper member 130, 146 may extend beyond only one edge or may not extend beyond either edge of the associated conveyor surface 38, 62. Further, each scraper 130, 146 within a plurality of scrapers may extend beyond an edge different than that of the adjacent scrapers 130, 146 to produce a pattern (e.g., inner, outer, both, none, inner, outer, both, none, etc.). In still other constructions (not shown), one or more pushers 52, 82 may not include a scraper member 130, 146.

In the illustrated construction, the cover member 86 extends generally less than the full length of the conveyors 22, 26 to provide clearance for the scraper members 130, 146 as the scraper members 130, 146 travel with the chains 50, 54, 74, 78 around the sprockets. The cover member 86 may include a downwardly-curved portion (not shown) following the travel path of the scraper members 130, 146 while still covering the chains 50, 54, 74, 78 and the sprockets. The outer chain covers 114 may be arranged in a similar manner to the cover member 86.

In the illustrated construction, the divider member 94 extends a sufficient height to restrict engagement with and/or interference between the first scraper members 130 and the second scraper members 146. The divider member 94 may contribute to maintaining alignment of scraper members 130, 146.

Figure 5:
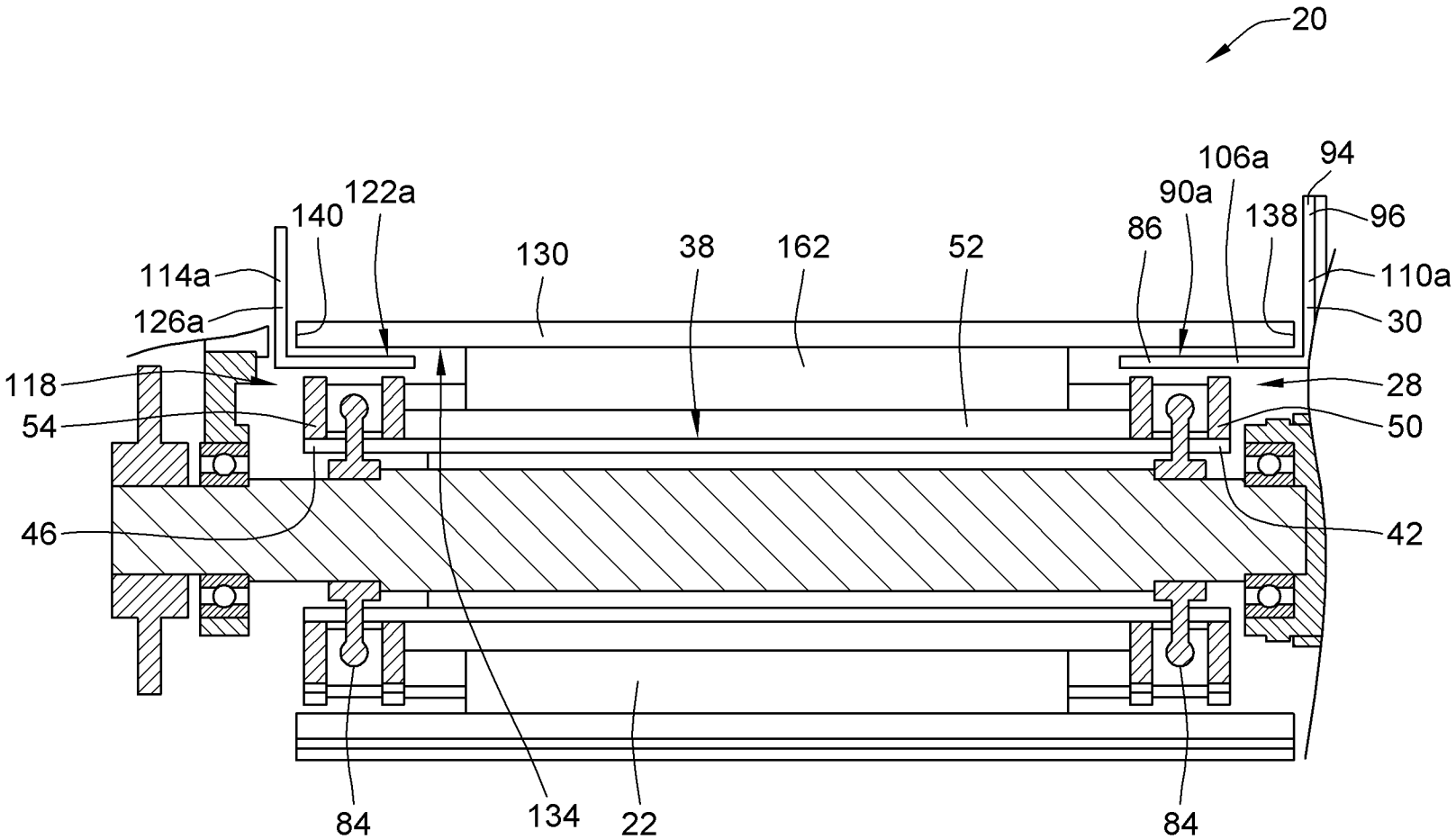
FIG. 5 is an enlarged view of a portion of the conveyor assembly shown in FIG. 4.

The cover assembly 30 and the outer covers 114 may be assembled to the conveyor assembly 20 before attachment of the scraper members 130, 146 to the associated pushers 52, 82. The cover assembly 30 is positioned over the central space 28 and secured to the paver (e.g., by the fasteners 112). The outer covers 114 may be connected to the paver 10 in a similar manner. Thereafter, the scraper members 130, 146 are connected to the pushers 52, 82. As shown in FIGS. 4-7, the cover member 86 is thus sandwiched between the first inner chain 50 and the first scraper members 130 and between the second inner chain 74 and the second scraper members 146. Similarly, as shown in FIGS. 4-6, the first outer cover 114*a* is sandwiched between the first outer chain 54 and the first scraper members 130, and the second outer cover 114*b* is sandwiched between the second outer chain 78 and the second scraper members 146. Alternatively, the scraper members 130, 146 may first be connected to the pushers 52, 82, and the cover assembly 30 and the outer covers 114 may then be inserted (e.g., from an axial end) and connected to the paver 10.

Figure 8:
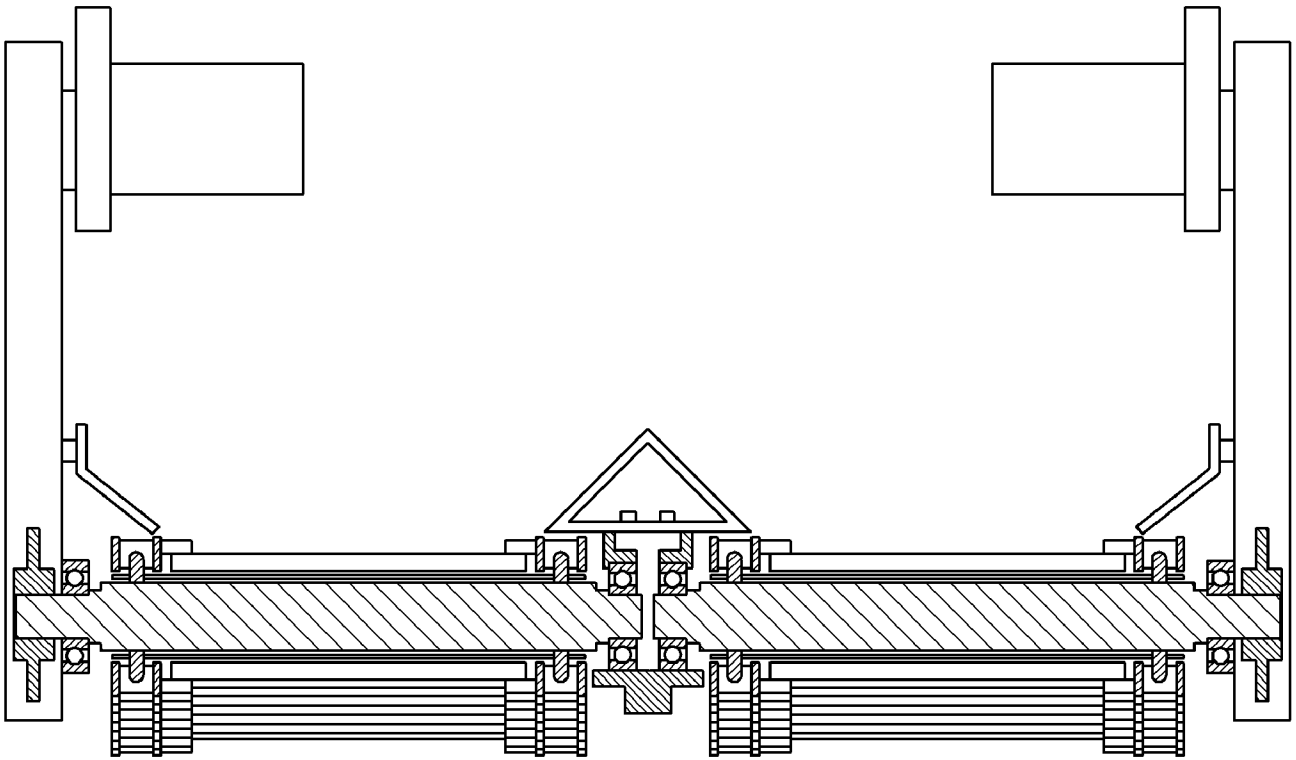
FIG. 8 (PRIOR ART)
FIG. 8 is a partial cross-sectional rear view of a conveyor assembly of an existing asphalt paving machine.

The cover assembly 30 may be initially installed during assembly of a paver 10 or may be retrofitted onto an existing paver, such as the paver 210 shown in FIG. 8. When retrofitting, the cover assembly 30 may replace an existing cover assembly, such as the cover assembly 230, or may provide a center cover if the existing paver did not previously have a center cover. Similarly, the outer chain covers 114 may be retrofitted onto an existing paver, such as the paver 210, to replace existing outer covers 314 or to provide outer covers if they were not provided in the existing paver.

The scraper members 130, 146 may be installed during assembly of a paver 10 or may be retrofitted onto an existing paver, such as the paver 210 shown in FIG. 8. If the scraper members 130, 146 are retrofitted with the cover assembly 30 and/or with the outer chain covers 114, the scraper members 130, 146 may generally have the configuration shown in FIGS. 2-7 and described above. If the scraper members 130, 146 are retrofitted with or onto a different cover assembly, such as the cover assembly 230 and/or the outer covers 314, the scraper members 130, 146 will have a configuration to cooperate with the cover assembly (e.g., an angled lower surface to move along the angled upper surface of the cover assembly 230 and/or of the outer covers 314).

It should be understood that, in some constructions, the cover assembly 30 may be used without the scraper members 130, 146 or vice versa.

It should also be understood that, in some constructions, the cover assembly 30 may be used without the illustrated outer chain covers 114 or vice versa. For example, the cover assembly 30 could be used with the existing outer covers 314 shown in FIG. 8. Also, in a paver including only one conveyor, because there is no central space 28, only outer covers 114 may be provided.

It should be understood that, while, in the illustrated construction, the paver 10 includes a pair of conveyors 22, 26, in other constructions, any number of conveyors may be provided. For example, in a paver with more than two conveyors, a cover assembly 30 may be provided between each of the adjacent conveyors, and outer chain covers 114 may be provided at the outermost conveyor edges. Also, as mentioned above, in a paver including only one conveyor, because there is no central space 28, only outer covers 114 may be provided.

One or more independent features and/or independent advantages of the invention may be set forth in the following claims:

What is claimed is:

1. A conveyor assembly for an asphalt paving machine, the assembly being operable to convey material in the paving machine, the assembly comprising:

a first conveyor including a first conveyor surface having an inner edge and an outer edge, and a first drive chain adjacent the inner edge of the conveyor surface, the first drive chain being movable to cause material to be conveyed on the first conveyor surface;

a second conveyor generally parallel to the first conveyor, a central space being defined between the first conveyor and the second conveyor, the second conveyor including a second conveyor surface having an inner edge and an outer edge, and a second drive chain adjacent the inner edge of the conveyor surface, the second drive chain being movable to cause material to be conveyed on the second conveyor surface; and a cover assembly including a cover member positioned over the central space and covering the first drive chain and the second drive chain, the cover member having an upper surface substantially parallel to the first conveyor surface and to the second conveyor surface, the upper surface being positioned to directly engage and support material, at least a substantial portion of the upper surface directly engaging and supporting material, the cover member substantially preventing material from entering the central space between the first conveyor and the second conveyor, and a divider member connected to the cover member and extending generally perpendicular to the upper surface, the divider member being positioned to directly engage material supported on the upper surface, the divider member having a divider upper surface, a first side facing toward the first conveyor and a second side facing toward the second conveyor, at least a substantial portion of the first side and the second side directly engaging material on the upper surface of the cover member.

2. The assembly of claim 1, wherein the cover assembly is provided by a first cover section and a second cover section, each cover section having a substantially "L" shape and including a first leg, providing a portion of the upper surface of the cover member, and a second leg, providing a portion of the divider member, the second leg being generally perpendicular to the first leg, the first leg of the first cover section providing a first portion of the upper surface of the cover member, the first leg of the second cover section providing a second portion of the upper surface of the cover member.

3. The assembly of claim 1, and further comprising:

a first scraper member connected to the first drive chain and extending inwardly beyond the inner edge of the first conveyor surface, the first scraper member extending over a first portion of the upper surface of the cover member when the first drive chain is positioned with the first scraper member above the upper surface, the first scraper member being operable to move material on the upper surface of the cover member during movement of the first drive chain; and a second scraper member connected to the second drive chain and extending inwardly beyond the inner edge of the second conveyor surface, the second scraper member extending over a second portion of the upper surface of the cover member when the second drive chain is positioned with the second scraper member above the upper surface, the second scraper member being operable to move material on the upper surface of the cover member during movement of the second drive chain.

4. The assembly of claim 3, wherein the first scraper member has a lower surface movable along the first portion of the upper surface of the cover member when the first drive chain is positioned with first scraper member above the upper surface, and wherein the second scraper member has a lower surface movable along the second portion of the upper surface of the cover member when the second drive chain is positioned with the second scraper member above the upper surface.

5. The assembly of claim 3, wherein the first scraper member has a forward surface substantially perpendicular to the upper surface of the cover member when the first drive chain is positioned with the first scraper member above the upper surface, and wherein the second scraper member has a forward surface substantially perpendicular to the upper surface of the cover member when the second drive chain is positioned with the second scraper member above the upper surface.

6. The assembly of claim 3, wherein the first scraper member has an inner end extending proximate to the first side of the divider member when the first drive chain is positioned with the first scraper member above the upper surface, and wherein the second scraper member has an inner end extending proximate to the second side of the divider member when the second drive chain is positioned with the second scraper member above the upper surface.

7. The assembly of claim 6, wherein the first conveyor further includes a first outer chain adjacent the outer edge of the first conveyor surface, and a first pusher connected to the first drive chain and to the first outer chain, the first pusher being movable with the first drive chain to convey material on the first conveyor surface, the first scraper member being connected to the first pusher, and wherein the second conveyor further includes a second outer chain adjacent the outer edge of the second conveyor surface, and a second pusher connected to the second drive chain and to the second outer chain, the second pusher being movable with the second drive chain to convey material on the second conveyor surface, the second scraper member being connected to the second pusher.

8. The assembly of claim 7, wherein the first conveyor further includes a plurality of first pushers connected to the first drive chain and to the first outer chain, each of the plurality of first pushers providing a first scraper member, and wherein the second conveyor further includes a plurality of second pushers connected to the second drive chain and to the second outer chain, each of the plurality of second pushers providing a second scraper member.

9. The assembly of claim 7, and further comprising:

a first outer cover positioned over and covering the first outer chain, the first outer cover having a first outer cover upper surface substantially parallel to the first conveyor surface, the first outer cover upper surface being positioned to directly engage and support material, at least a substantial portion of the first outer cover upper surface directly engaging and supporting material, the first outer cover substantially preventing material from entering the first outer chain;

a first outer scraper member connected to the first pusher and extending outwardly beyond the outer edge of the first conveyor surface, the first outer scraper member extending over a portion of the upper surface of the first outer cover when the first drive chain is positioned with the first outer scraper member above the upper surface of the first outer cover, the first outer scraper member being operable to move material on the upper surface of the first outer cover during movement of the first drive chain;

a second outer cover positioned over and covering the second outer chain, the second outer cover having a second outer cover upper surface substantially parallel to the second conveyor surface, the second outer cover upper surface being positioned to directly engage and support material, at least a substantial portion of the second outer cover upper surface directly engaging and supporting material, the second outer cover substantially preventing material from entering the second outer chain; and a second outer scraper member connected to the second pusher and extending outwardly beyond the outer edge of the second conveyor surface, the second outer scraper member extending over a portion of the upper surface of the second outer cover when the second drive chain is positioned with the second outer scraper member above the upper surface of the second outer cover, the second outer scraper member being operable to move material on the upper surface of the second outer cover during movement of the second drive chain.

10. A conveyor assembly for an asphalt paving machine, the assembly being operable to convey material in the paving machine, the assembly comprising:

a first conveyor including a first conveyor surface having an inner edge and an outer edge, and a first drive chain adjacent the inner edge of the first conveyor surface, the first drive chain being movable to cause material to be conveyed on the first conveyor surface;

a second conveyor generally parallel to the first conveyor, a central space being defined between the first conveyor and the second conveyor, the second conveyor including a second conveyor surface having an inner edge and an outer edge, and a second drive chain adjacent the inner edge of the second conveyor surface, the second drive chain being movable to cause material to be conveyed on the second conveyor surface;

a cover positioned over the central space and covering the first drive chain and the second drive chain, the cover having an upper surface, the cover substantially preventing material from entering the central space between the first conveyor and the second conveyor;

a first scraper member connected to the first drive chain and extending inwardly beyond the inner edge of the first conveyor surface, the first scraper member extending over a first portion of the upper surface of the cover when the first drive chain is positioned with the first scraper member above the upper surface, the first scraper member being operable to move material on the upper surface of the cover during movement of the first drive chain; and a second scraper member connected to the second drive chain and extending inwardly beyond the inner edge of the second conveyor surface, the second scraper member extending over a second portion of the upper surface of the cover when the second drive chain is positioned with the second scraper member above the upper surface, the second scraper member being operable to move material on the upper surface of the cover during movement of the second drive chain.

11. The assembly of claim 10, wherein the first scraper member has a lower surface movable along the first portion of the upper surface of the cover when the first drive chain is positioned with the first scraper member above the upper surface, and wherein the second scraper member has a lower surface movable along the second portion of the upper surface of the cover when the second drive chain is positioned with the second scraper member above the upper surface.

12. The assembly of claim 10, wherein the first scraper member has a forward surface substantially perpendicular to the first conveyor surface when the first drive chain is positioned with the first scraper member above the upper surface, and wherein the second scraper member has a forward surface substantially perpendicular to the second conveyor surface when the second drive chain is positioned with the second scraper member above the upper surface.

13. The assembly of claim 10, wherein the first conveyor further includes a first outer chain adjacent the outer edge of the first conveyor surface, and a first pusher connected to the first drive chain and to the first outer chain, the first pusher being movable with the first drive chain to convey material on the first conveyor surface, the first scraper member being connected to first pusher, and wherein the second conveyor further includes a second outer chain adjacent the outer edge of the second conveyor surface, and a second pusher connected to the second drive chain and to the second outer chain, the second pusher being movable with the second drive chain to convey material on the second conveyor surface, the second scraper member being connected to the second pusher.

14. The assembly of claim 13, wherein the first conveyor further includes a plurality of first pushers connected to the first drive chain and to the first outer chain, each of the plurality of first pushers providing a first scraper member, and wherein the second conveyor further includes a plurality of second pushers connected to the second drive chain and to the second outer chain, each of the plurality of second pushers providing a second scraper member.

15. The assembly of claim 10, wherein the upper surface of the cover is generally parallel to the first conveyor surface and to the second conveyor surface.

16. The assembly of claim 15, wherein the cover is provided by a cover assembly including a cover member providing the upper surface, and a divider member connected to the cover member and extending generally perpendicular to the upper surface.

17. The assembly of claim 16, wherein the divider member has a first side surface facing toward the first conveyor and a second side surface facing toward the second conveyor, wherein the first scraper member has an inner end extending proximate to the first side surface of the divider member when the first drive chain is positioned with the first scraper member above the upper surface, and wherein the second scraper member has an inner end extending proximate to the second side surface of the divider member when the second drive chain is positioned with the second scraper member above the upper surface.

18. The assembly of claim 16, wherein the cover assembly is provided by a first cover section and a second cover section, each cover section having a substantially "L" shape and including a first leg, providing a portion of the upper surface of the cover member, and a second leg, providing a portion of the divider member, the second leg being generally perpendicular to the first leg, the first leg of the first cover section providing a first portion of the upper surface of the cover member, the first leg of the second cover section providing a second portion of the upper surface of the cover member.

19. The assembly of claim 13, and further comprising:

a first outer cover positioned over and covering the first outer chain, the first outer cover having first outer cover upper surface substantially parallel to the first conveyor surface, the first outer cover substantially preventing material from entering the first outer chain;

a first outer scraper member connected to the first pusher and extending outwardly beyond the outer edge of the first conveyor surface, the first outer scraper member extending over a portion of the upper surface of the first outer cover when the first drive chain is positioned with the first outer scraper member above the upper surface of the first outer cover, the first outer scraper member being operable to move material on the upper surface of the first outer cover during movement of the first drive chain;

a second outer cover positioned over and covering the second outer chain, the second outer cover having a second outer cover upper surface substantially parallel to the second conveyor surface, the second outer cover substantially preventing material from entering the second outer chain; and a second outer scraper member connected to the second pusher and extending outwardly beyond the outer edge of the second conveyor surface, the second outer scraper member extending over a portion of the upper surface of the second outer cover when the second drive chain is positioned with the second outer scraper member above the upper surface of the second outer cover, the second outer scraper member being operable to move material on the upper surface of the second outer cover during movement of the second drive chain.

20. An asphalt paving machine comprising:

a first conveyor including a first conveyor surface having an inner edge and an outer edge, a first inner chain adjacent the inner edge of the conveyor surface, a first outer chain adjacent the outer edge of the conveyor surface, and a plurality of first pushers connected to the first inner chain and to the first outer chain, each first pusher being movable to convey material on the first conveyor surface;

a second conveyor generally parallel to the first conveyor, a central space being defined between the first conveyor and the second conveyor, the second conveyor including a second conveyor surface having an inner edge and an outer edge, a second inner chain adjacent the inner edge of the conveyor surface, a second outer chain adjacent the outer edge of the conveyor surface, and a plurality of second pushers connected to the second inner chain and to the second outer chain, each second pusher being movable to convey material on the second conveyor surface;

a hopper for dispensing material to be conveyed onto the first conveyor and onto the second conveyor;

a cover assembly including a cover member positioned over the central space and covering the first inner chain and the second inner chain, the cover member having an upper surface substantially parallel to the first conveyor surface and to the second conveyor surface, the cover member substantially preventing material from entering the central space between the first conveyor and the second conveyor, and a divider member connected to the cover member and extending generally perpendicular to the upper surface;

a plurality of first scraper members, each first scraper member being connected to an associated first pusher and extending inwardly beyond the inner edge of the first conveyor surface, each first scraper member extending over a first portion of the upper surface of the cover member and to one side of the divider member when the first inner chain is positioned with the first scraper member above the upper surface, each first scraper member being operable to move material on the upper surface of the cover member during movement of the first inner chain; and a plurality of second scraper members, each second scraper member being connected to an associated second pusher and extending inwardly beyond the inner edge of the second conveyor surface, each second scraper member extending over a second portion of the upper surface of the cover member and to an opposite side of the divider member when the second inner chain is positioned with the second scraper member above the upper surface, each second scraper member being operable to move material on the upper surface of the cover member during movement of the second inner chain.

* * * * *